United States Patent [19]

Zaruba et al.

[11] Patent Number: 4,623,319

[45] Date of Patent: Nov. 18, 1986

[54] FIGURE INCLUDING EXTRUSION MEANS ACTUATED BY FIGURE APPENDAGES

[75] Inventors: John V. Zaruba, Chicago; Burton C. Meyer, Downers Grove, both of Ill.; Robert L. Lindsay, Harrison; Michael J. Oppenheim, Cincinnati, both of Ohio

[73] Assignee: Marvin Glass & Associates, Chicago, Ill.

[21] Appl. No.: 695,886

[22] Filed: Jan. 29, 1985

Related U.S. Application Data

[63] Continuation-in-part of Ser. No. 543,408, Oct. 19, 1983.

[51] Int. Cl.[4] ..... A63H 3/36

[52] U.S. Cl. ..... 446/373; 425/190; 425/542; 425/DIG. 57; 446/267; 446/320; 446/340; 446/475; 446/489

[58] Field of Search ..... 446/267, 268, 320, 321, 446/327, 319, 330, 337, 339, 341, 372, 373, 376, 382, 385, 391, 424, 475, 489; 425/190, 542, DIG. 57; 222/319

[56] References Cited

U.S. PATENT DOCUMENTS 3,741,706 6/1973 Conley et al. ..... 425/DIG. 57

4,518,367 5/1985 Zaruba et al. ..... 446/267 X

FOREIGN PATENT DOCUMENTS 533988 10/1955 Italy ..... 425/542

*Primary Examiner*—F. Barry Shay

*Attorney, Agent, or Firm*—John S. Pacocha

[57] ABSTRACT

An activity toy with a body including a hollow cylindrical portions supported on a base and having pivotally mounted arms has a hollow upper member including a skull with extrusion openings. The bottom of the upper member has a loading opening for a plastic amorphous solid substance. Attachable about and spaced from the skull is a clear plastic mask formed of separable halves clamped together at the bottom by the engagement of hooks and tabs and at the top by a detachable hairpiece. Near the bottom, the mask is maintained in a relatively tight relation to a flange on the hollow upper member. The upper member with the mask attached is secured to the body by a bayonet lock. Within the body is a piston with diametrically opposed gear racks that are engaged by gear segments on arms pivotally mounted to the body. Movement of the arms from an upraised position down to a lower position drives the piston into the hollow member through the loading opening to extrude the plastic amorphous substance out of the extrusion openings in the skull and fill the clear plastic mask.

11 Claims, 15 Drawing Figures

FIGURE INCLUDING EXTRUSION MEANS ACTUATED BY FIGURE APPENDAGES

This invention is a continuation-in-part of application Ser. No. 543,408 filed Oct. 19, 1983.

BACKGROUND OF THE INVENTION

1. Field of the Invention

This invention relates generally to toy figures and more particularly to a toy figure that is combined with a plastic substance extruder for forming the face and head of the figure.

2. Background Art

Figures and dolls have long been popular toys with both boys and girls. More recently, figures resembling monsters or fantasy characters have become very popular. Clay and other plastic substances have long provided children with entertaining activity including the sculpting of heads or faces. However, not all children have the innate artistic ability or talent to make a satisfying head or face. Prior art toys have provided children with mechanical molding means for clay or similar plastic substances such as in U.S. Pat. No. 3,685,936 to mold animal-like characters. Other toys such as the LJN "DR. MAD'S HAIRY-SCARY MONSTERS" and the KENNER "FUZZY PUMPER" pet shop have combined mechanical extruder bases with hollow apertured attachments for monsters and animal-like figures for the purpose of extruding a mass of strands of a plastic substance to decorate the figure with "hair" or the like. There remains, however, a need for an activity toy that combines a figure with a self-contained extruding mechanism and provisions for molding a head and face that is operable during play with the figure in an entertaining way and produces a result that is aesthetically pleasing to the child.

SUMMARY OF THE INVENTION

The present invention is concerned with providing a figure that includes a self-contained extruding mechanism and a mold for forming an aesthetically pleasing head and face for the figure in an entertaining manner. These and other objects and advantages of the invention are achieved by a figure that has a hollow skull extending from a tubular neck and having openings for the eyes, nose and mouth and which combines with a separable clear mask that is attached such that the mask is relatively tight about the neck but is spaced from the skull. The figure supports a mechanism for forcing a plastic amorphous solid substance loaded into the skull through the tubular neck out of the eye, nose, and mouth openings to fill the mask to form a face with the substance. Separating and removing the mask permits further play with the formed face and head. The figure is provided with suitable appendages, which interact with the extrusion mechanism, as well as a cloak or other covering to obscure the mechanism and permit additional play with the figure.

BRIEF DESCRIPTION OF THE DRAWING

For a better understanding of the present invention reference may be had to the accompanying drawings in which.

DETAILED DESCRIPTION OF THE PREFERRED EMBODIMENT

Figure 1:
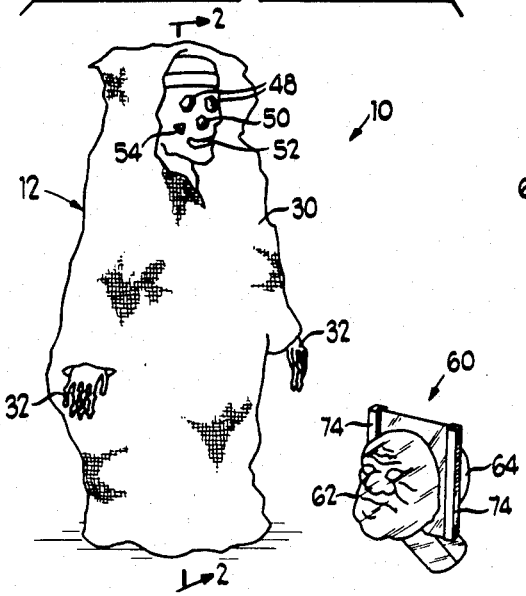
FIG. 1 is a perspective view of the cloaked figure plus the clear mask and extruder piston.
Figure 3:
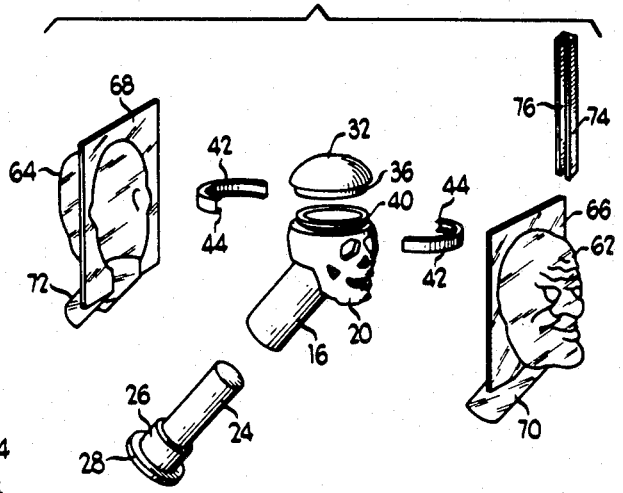
FIG. 3 is an enlarged scale exploded perspective view of the skull, mask and extruder piston.
Figure 2:
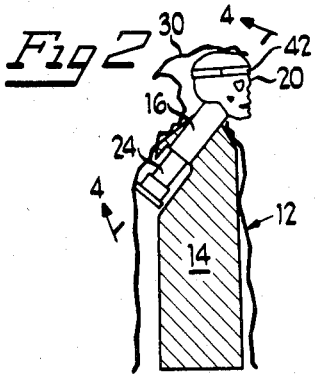
FIG. 2 is a reduced scale side elevational view partially in section along line 2—2 of FIG. 1.
Figure 12:
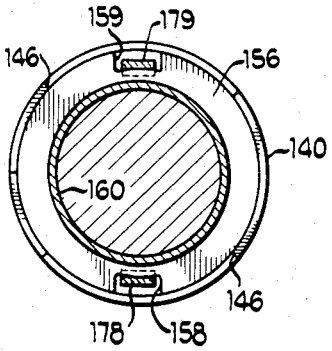
FIG. 12 is a sectional view taken generally along the line 12—12 of FIG. 11.
Figure 13:
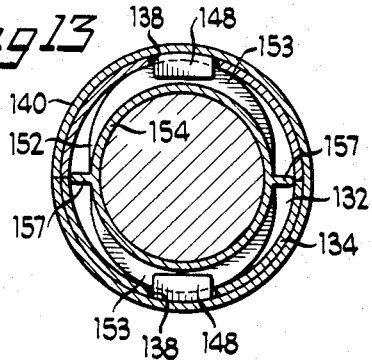
FIG. 13 is a sectional view taken generally along the line 13—13 of FIG. 11.
Figure 14:
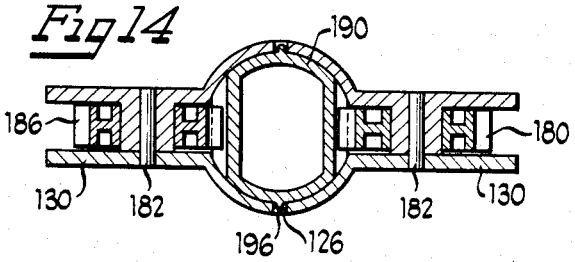
FIG. 14 is a sectional view taken generally along the line 14—14 of FIG. 10.
Figure 15:
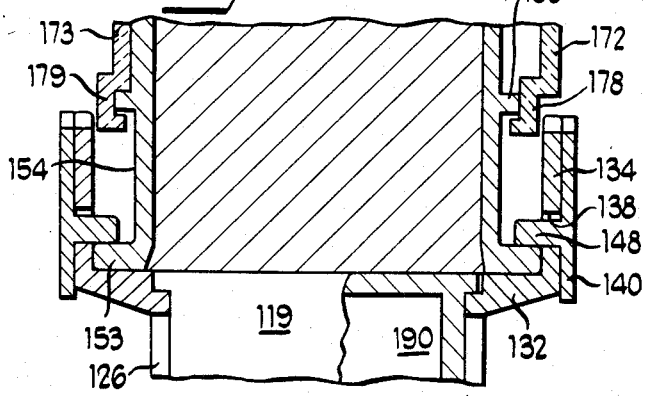
FIG. 15 is a further enlarged fragmentary sectional view taken generally along the same line as FIG. 11.

Referring now to the drawings in which like parts are designated by like reference numerals throughout the several views, there is shown in FIG. 1 an activity toy 10 that includes a toy FIG. 12. In this embodiment the figure is somewhat simplified and has a generally cylindrical body 14. An upper member includes a tubular neck 16 mounted in the body at an angle of approximately 45 degrees to the vertical center of the body and has an upper outwardly extending end that supports a hollow skull 20. Both the neck tube 16 and the hollow skull 20 may be integrally formed with the body 14 or otherwise permanently mounted on the body. The open lower end of the tubular neck 16 receives a sliding extrusion piston 24 that has a shouldered portion 26 on the back end to prevent the piston being pushed all the way into the tubular neck 16. To facilitate pushing the piston with a thumb or finger a further enlarged portion 28 is provided behind the shouldered portion. As is best illustrated in FIG. 2, the piston 24 extends out of the back of the figure at a point below the shoulder so that the piston may be pushed into the neck 16 by the thumb of a hand grasping the body of the FIG. 12.

In order to provide a monster-like appearance, the skull 20, neck 16, and body 14 are covered with a hooded cloak 30 which obscures the extrusion mechanism. Appendages, such as bony hands 32, extend from sleeves or openings in the cloak and may be attached directly to the cloak. Alternatively, the body 14 may be shaped to more closely conform to that of the monster or other fantasy character being represented. In addition, arms (not shown) could be attached to the body and through a suitable linkage (not shown) be used to operate the extrusion mechanism. Similarly, it will be apparent to those skilled in the art, that different types of extrusion mechanisms, such as a screw type extruder, could be used.

Hollow skull 20 may be integrally formed with the neck 16 and is provided with a detachable cap 32 for access to the interior of the skull for cleaning purposes. The cap and the skull are generally circular along the plane on which they abut. Spaced from the lower edge of cap 32 is a circular groove 34 below which depends a cylindrical wall portion 36 that is an integral part of the cap. A similar circular groove 38 is spaced from the top edge of the skull 20 a distance substantially equal to the spacing of the groove 34 from the bottom edge of the cap 32. Extending upwardly from the groove 38 is a circumferential wall 40. Opposed retaining C-shaped bands 42 have inwardly directed flanges 44 which fit into the grooves 34 and 38 to secure the cap 32 and the skull 20 together. The size of the C-shaped bands 42 is equal to or slightly smaller than the circumference of the cap and skull adjacent the plane of the attachment and the bands are retained in the grooves to keep the cap and skull together.

Figure 4:
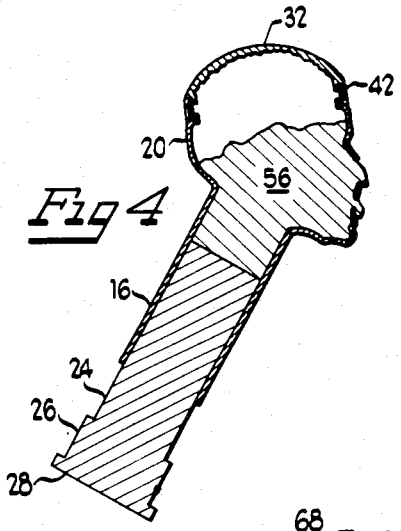
FIG. 4 is an enlarged scale sectional view taken generally along the line 4—4 of FIG. 2.
Figure 5:
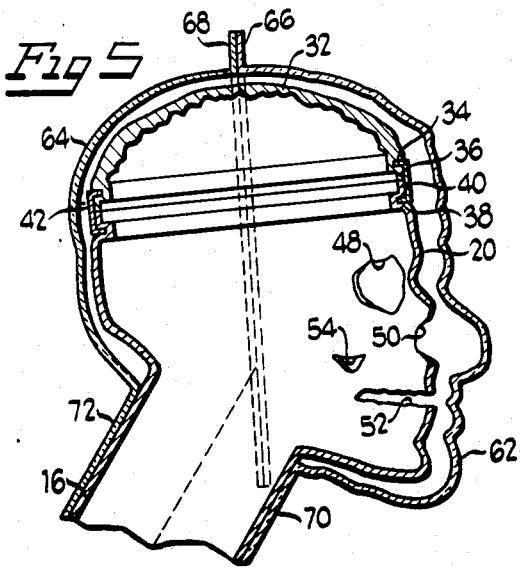
FIG. 5 is a further enlarged scale side elevational view in section generally through the center of the skull and neck with the mask attached.
Figure 6:
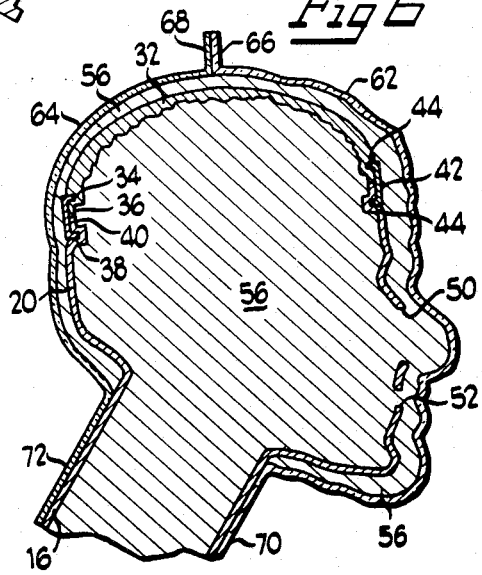
FIG. 6 is a sectional view similar to FIG. 5 with both the skull and mask filled with the plastic substance.
Figure 7:
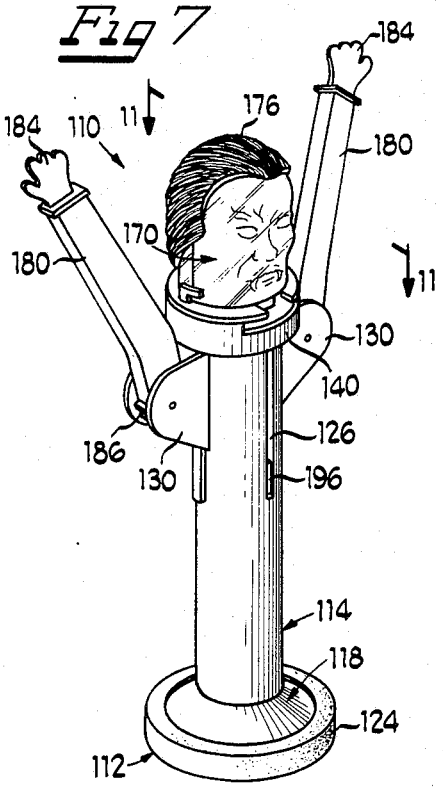
FIG. 7 is a perspective view of an alternative embodiment.
Figure 8:
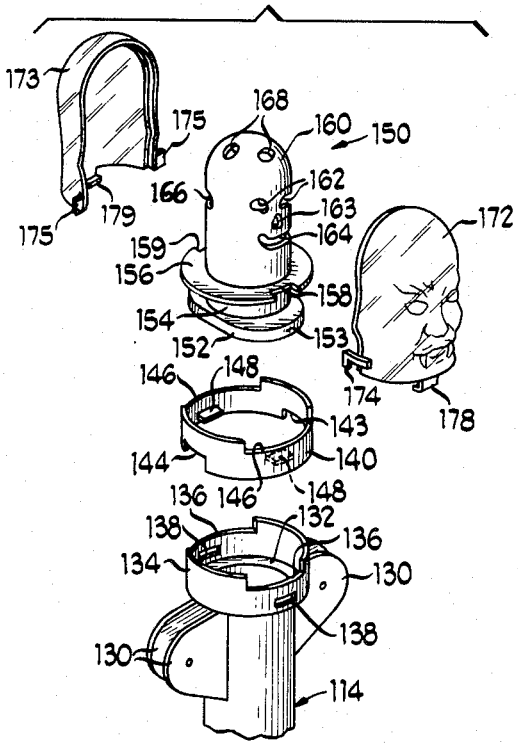
FIG. 8 is an exploded parts perspective view.
Figure 9:
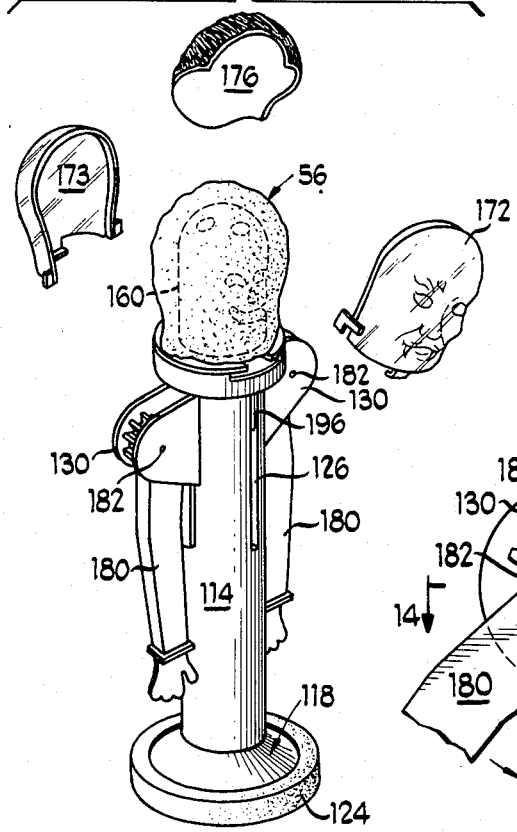
FIG. 9 is a perspective view after extrusion of the plastic substance and with the mask removed.
Figure 10:
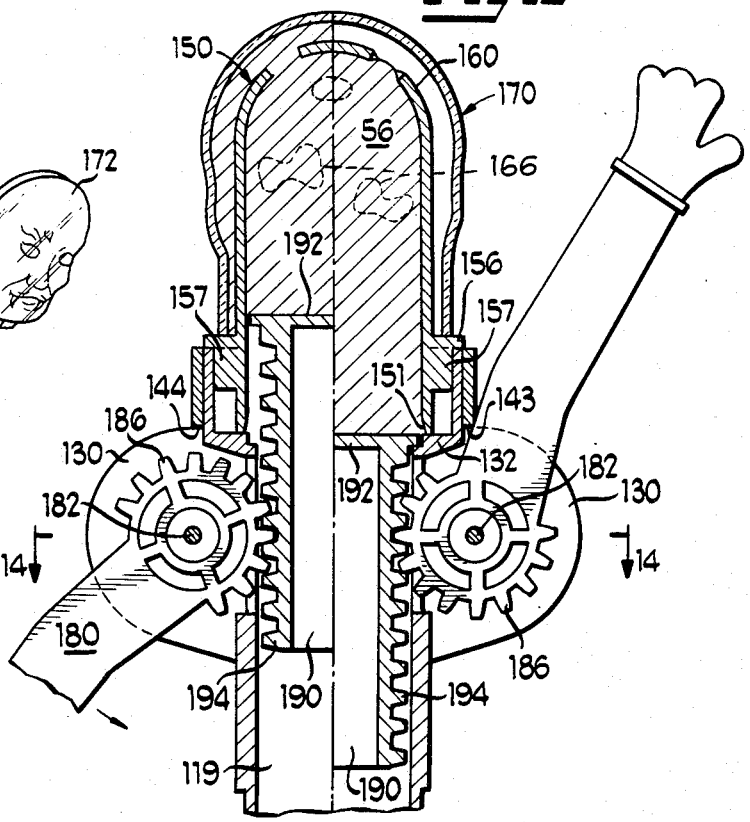
FIG. 10A is an enlarged scale, fragmentary, sectional view of the right hand side of FIG. 7 taken generally along a vertical plane forward of the arm.
FIG. 10B is an enlarged scale, fragmentary, sectional view of the left hand side of FIG. 9 taken generally along a vertical plane forward of the arm.
Figure 11:
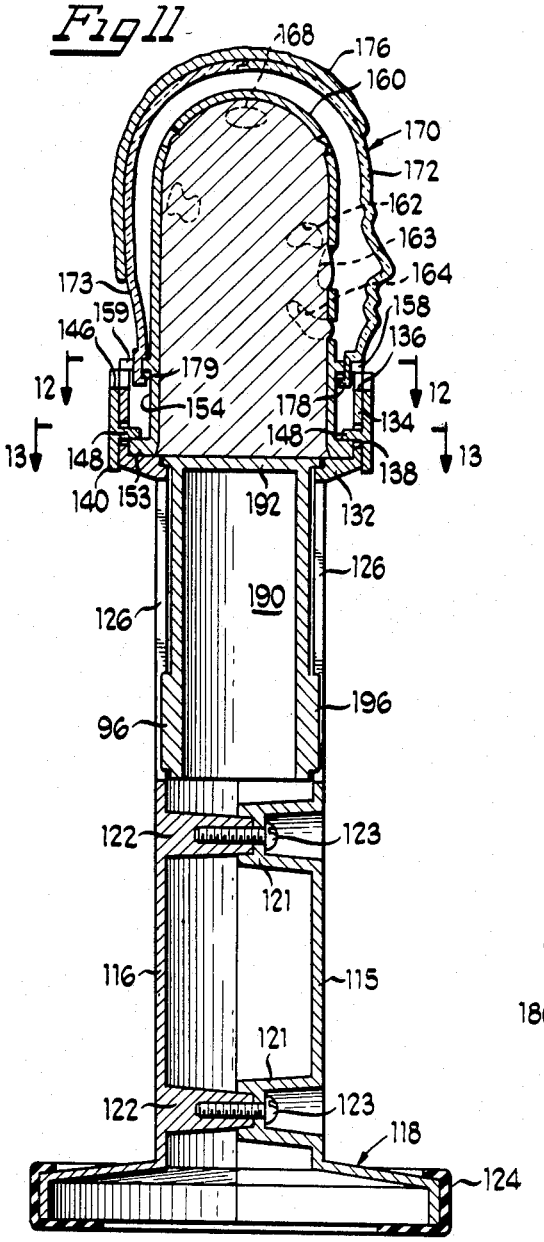
FIG. 11 is an enlarged scale sectional view taken generally along the line 11—11 of FIG. 7.

The front of skull 20 is provided with a number of openings representing eye sockets 48, nose cavity 50, mouth 52, and holes in the cheeks 54. Accordingly, the FIG. 12, as illustrated in FIG. 1, comprises a hooded, cloaked skeleton-like monster which may be played in the same manner as a conventional monster or fantasy figure. In addition, the interior of the skull 20 is loadable with a colored clay or other malleable amorphous solid 56 used by children for modeling and other activities. With the piston 24 inserted as shown in FIGS. 2 and 4, pushing the piston into the neck 16 with a thumb or finger will cause some of the substance 56 to be extruded out of the openings in the skull.

A relatively rigid clear mask 60 is formed of two separable front and back halves 62 and 64, respectively, each having a substantially uniformed wall thickness. The front half 62 has the external appearance of the face and the interior forms a mold cavity for a face. Back half 64 forms the remainder of the head, both externally and internally. Halves 62 and 64 have a projecting plate 66 and 68, respectively, that lies in the generally vertical parting line plane. In addition, each portion has a respective downwardly extending semicylindrical front sleeve 70 and back sleeve 72.

When abutted, sleeves 70 and 72 conform substantially to the outer dimension of the tubular neck 16 creating a relatively tight fit about the neck. The rectangular plates 66 and 68 are of substantially identical outer dimensions so that when the two halves 62 and 64 of the mask 60 are assembled with the edges of the rectangular plates aligned, the sleeves 70 and 72 fit about the neck 16. Clamps 74 placed over the side edges of the joined plates 66 and 68 secure the two separable halves together. As with the C-shaped bands 42, the rectangular clamps 74 are formed of a resilient material and have a slot 76 that is slightly narrower than the combined thicknesses of the plates 66 and 68 to retain the clamps 74 in place. Because the lower side edges of the rectangular plates extend down below the face and head to intersect an upper portion of the sleeves, the clamps 74 also sufficiently secure the top of the sleeves 70 and 72 about the neck 16.

With the detachable cap 32 on and the separable halves 62 and 64 clamped together about the neck 16 to form mask 60, plastic substance 56 extruded out of the hollow skull 20 through the openings 48, 50, 52, and 54 fills the annular space between the skull 20 and the interior of the mask 60 to form a face and head for the FIG. 12. In order to facilitate putting the mask on, the hood portion of the cloak 30 may be flipped off the skull, and after the mask is in place flipped back up to substantially hide the clamped parting plates 66 and 68. Once the face and head has been formed by pushing the piston 24 into the neck 16, the mask 60 may be removed and the child may further play with the face and head thus created. For example, a child could, with fingers or other tools, modify the formed face particularly in the region of the openings 48, 50, 52, and 54. Further pressure on the piston 24 will then cause additional material to be extruded out through the openings to expand and deform the already formed face and perhaps erupt out of the weakened regions.

In another embodiment shown in FIGS. 7–15, an activity toy 110 has a base 112 supporting a simplified generally cylindrical body 114. The body is assembled of halves 115 and 116 the lower portions of which form a base 118 of a greater diameter. An upper portion 119 of the body is hollow. Body half 115 is provided with a pair of spaced apart female bosses 121 and body half 116 is provided with spaced apart male bosses 122. Respective mating bosses 121 and 122 are secured together by means of screws 123. Fitted over the base 118 is a rubber cap 124 that helps stabilize the base on a table or other surface. Upper portion 119 is provided with diametrically opposed guide grooves 126. Extending generally parallel to a diameter substantially transverse to the diameter between the opposed guide grooves 126 are opposed pairs of spaced apart shoulder brackets 130.

At the top of the upper portion 119 is an annular flange 132 with a peripheral upwardly extending collar 134. A pair of diametrically opposed upper recesses 136 are provided along the upper edge of the collar 134. Below the upper recesses 136, a pair of slots 138 extend through the collar 134 such that the center of one of each of the guide grooves 126, slot 138 and upper recess 136 are generally vertically aligned. An outer split ring 140 is provided with diametrically opposed lower gaps 143 and 144. Approximately ninety degrees away from the lower gaps are upper recesses 146 along the upper edge of the ring 140. About midway up the side of the ring 140 and generally aligned with the center of each of the upper recesses 146 are inwardly directed lugs 148 which fit into and extend inwardly beyond a respective one of the slots 138 in the collar 134. When the outer split ring is assembled to the collar 134, the gaps 144 provide clearance for the shoulder brackets 130.

Mountable atop, in bayonet locking engagement with the body 114 is an upper hollow member 150 that has a bottom opening 151 and a bottom oblong ledge 152 providing diametrically opposed outwardly projecting lobes 153. Extending upwardly from the ledge is a neck portion 154. Spaced above the ledge 152 is a neck flange 156 with integral supporting struts 157. Flange 156 has a front notch 158 and a diametrically opposed rear notch 159. Upper member 150 includes a hollow skull 160 above the neck flange 156.

Hollow skull 160 is provided with a number of openings representing eye sockets 162, nose cavity 163, mouth 164, as well as openings 166 in the rear of the skull and openings 168 in the pate. A relatively rigid clear mask 170 is securable over the skull 160. The interior of mask 170 is generally spaced from the skull 160 but abuts and fits relatively tightly about the neck flange 156 to provide a contained space. Mask 170 is assembled of a separable front half 172 and a separable back half 173. Adjacent the bottom open sides of the front half 172 are hooks 174 that fit over side tabs 175 adjacent the bottom of the back half 173 to clamp the two halves together at the bottom. A detachable hairpiece shell 176 fits tightly over, and clamps, the top of the assembled front and back halves. Along the bottom edge at the front of front half 172 is an inwardly extending L-shaped front lip 178 and the back half 173 has an inwardly directed L-shaped rear lip 179. When the two halves of the mask are assembled about the skull, the front lip 178 fits into the front notch 158 and under the neck flange 156 while rear lip 179 fits into rear notch 159 and under the neck flange 156 thus securing the mask against both rotational and upward axial displacement of the mask relative to the skull.

An arm appendage 180 is mounted between each pair of spaced apart shoulder brackets for pivotal movement about a shoulder pin 182. The free end of each of the arms is provided with a hand 184 while the mounted end has a gear segment 186. Within the upper hollow portion 119 of the body, a hollow piston 190 with piston head 192 is received. The piston has a pair of outer, diametrically opposed, gear racks 194. Each gear rack 194 engages a respective one of the arm gear segments 186. Engagement between the piston gear racks and the arm gear segments is such that, as illustrated in the right-hand portion of FIG. 10, the piston is in a lowered position with the piston head 192 approximately at the same height as the annular flange 132 when the arms 180 are raised up all the way. As the arms are pushed down about the shoulder pins 182 the gear segments 186 engaging the racks 194 push the piston into the upper member 150 as illustrated in the left-hand portion of FIG. 10. Opposed ribs 196 on the piston ride in guide grooves 126 in the upper portion 119 of the body.

The colored clay or other malleable amorphous solid 56 is loaded into the hollow upper member 150 through the bottom opening 151 by hand. Preferably, a sufficient amount of the material is hand loaded so that it is almost flush with the bottom opening and just beginning to come out of the various skull openings 162, 163, 164, 166 and 168. Mask 170 may be secured about the skull 160 before or after loading the material 56. The mask and skull assembly is inserted into the open top of the collar 134 with the front of the skull and mask facing either of the arms 180. The skull and mask assembly is then rotated approximately ninety degrees until the lobes 153 of oblong ledge 152 bayonet lock under the inwardly extending lugs 148 to secure the assembly against upward axial displacement. As the arms 180 are then pushed down, the piston 190 forces some of the substance 56 out of the openings into the skull and fills the space between the skull and the mask. Subsequent play, as with the previously described embodiment, may then take place. Again, as with the previously described embodiment, this embodiment may be provided with a hooded cloak 30 to obscure the simplified body 114.

While particular embodiments of the invention have been shown and described, it will be apparent to those skilled in the art that further changes and modifications such as changing the arm appendages to legs may be made without departing from the invention. It is intended in the appended claims to cover all such changes and modifications that fall within the true spirit and scope of the invention.

What is claimed as new and desired to be secured by Letters Patent is:

1. An activity toy comprising:

a figure with a body supporting an upper member including a hollow skull with extrusion openings;

a loading opening in the member for inserting a plastic substance in the hollow skull;

extrusion means cooperating with the loading opening for forcing the plastic substance into the hollow skull and out of the extrusion openings;

a removable clear mask, means for attaching the mask about the skull with the interior of the mask spaced from the skull in the area of the extrusion openings and in a relatively tight fit with another portion of the member to substantially prevent the flow of the plastic substance out of the mask; and a pair of appendages pivotally mounted on the body with means for actuating the extrusion means through pivotal movement of the appendages.

2. The activity toy of claim 1 in which the extrusion mechanism includes a piston.

3. The activity toy of claim 1 in which the mask is formed of separable portions and includes clamping means for securing the portions together.

4. The activity toy of claim 1 including means compatible with the appearance of the character represented by the figure for obscuring the extrusion mechanism and mask attachment means.

5. The activity toy of claim 4 in which the obscuring means comprises a cloak.

6. The activity toy of claim 5 in which the cloak includes a hood.

7. An activity toy comprising:

a figure with a body supporting an upper member including a hollow skull with extrusion openings;

a loading opening in the upper member for inserting a plastic substance in the hollow skull;

extrusion means cooperating with the loading opening for forcing the plastic substance into the hollow skull and out of the extrusion openings;

a removable clear mask formed of separable portions;

means for attaching the mask about the skull with the interior of the mask spaced from the skull in the area of the extrusion openings and in a relatively tight fit with another portion of the member to substantially prevent the flow of the plastic substance out of the mask;

clamping means for securing the mask portions together including a detachable hair piece for securing the portions together remote from the loading opening in the upper member; and a pair of appendages pivotally mounted on the body with means for actuating the extrusion means through pivotal movement of the appendages.

8. The activity toy of claim 7 including bayonet locking means for securing the upper member to the body.

9. The activity toy of claim 7 in which the clamping means also includes hooks onone of the separable portions that clamp over tabs on another of the separable portions.

10. The activity toy of claim 7 in which:

the extrusion mechanism includes a piston provided with opposed gear racks; and each of the appendages is provided with a gear segment engageable with one of the gear racks.

11. The activity toy of claim 10 in which the piston has a head and the appendages are arms and the respective gear segments and gear raks engage such that the head of the piston is below the loading opening when the arms are in an upraised position and the head moves into the loading opening upon pivotal movement of the arms to a lowered position.

* * * * *